US005897161A

United States Patent [19]

Karg

[11] Patent Number: 5,897,161

[45] Date of Patent: Apr. 27, 1999

[54] TWO-DIRECTIONALLY FOLDING CHAIR

[76] Inventor: Peter W. Karg, Beacestr. 41, 13503 Berlin, Germany

[21] Appl. No.: 09/022,550

[22] Filed: Feb. 12, 1998

[30] Foreign Application Priority Data

Feb. 12, 1997 [DE] Germany ..... 297 03 297 U

[51] Int. Cl.[6] ..... A47C 4/30

[52] U.S. Cl. ..... 297/16.2; 297/45; 297/58

[58] Field of Search ..... 297/16.2, 16.1, 297/42, 45, 46, 58, 352, 230.11

[56] References Cited

U.S. PATENT DOCUMENTS

| | | | |
|---|---|---|---|
| 398,943 | 3/1889 | Crandall | 297/45 |
| 628,584 | 7/1899 | Kutz | 297/42 |
| 703,077 | 6/1902 | Nivison | 297/45 X |
| 1,795,911 | 3/1931 | Walker | 297/45 X |
| 1,942,112 | 1/1934 | McQuilkin | 297/45 |
| 2,104,255 | 1/1938 | Garbaccio | 297/45 |
| 2,713,385 | 7/1955 | McQuilkin | 297/45 |
| 3,021,175 | 2/1962 | Norquist | 297/58 |
| 3,042,447 | 7/1962 | Wilkinson | 297/58 |
| 3,635,520 | 1/1972 | Roher et al. | 297/45 |
| 4,118,065 | 10/1978 | Watkins | 297/45 |
| 4,652,047 | 3/1987 | Chan | 297/45 |
| 4,717,201 | 1/1988 | Barras | 297/16.2 |

FOREIGN PATENT DOCUMENTS

| | | | |
|---|---|---|---|
| 52031 | 5/1982 | European Pat. Off. | 297/16.2 |
| 6-197821 | 7/1994 | Japan | 297/16.2 |
| 635530 | 4/1950 | United Kingdom | 297/45 |

*Primary Examiner*—Jose V. Chen
*Assistant Examiner*—Rodney B. White
*Attorney, Agent, or Firm*—Sherman and Shalloway

[57] ABSTRACT

Folding chair (10) comprising a seat (20) carried by right-hand and lefthand front legs (11*a*, 11*c*) and righthand and lefthand rear legs (11*b*, 11*d*), and a back-rest (14) associated with said rear legs (11*b*, 11*d*) . Front legs (11*a*, 11*c*) and rear legs (11*b*, 11*d*) are interconnected for relative rotary movement. Likewise, the pairs of lefthand legs (11*a*, 11*b*) and righthand legs (11*c*, 11*d*) are interconnected for relative rotary movement.

25 Claims, 5 Drawing Sheets

TWO-DIRECTIONALLY FOLDING CHAIR

SPECIFICATION

The invention relates to a folding chair comprising a seat supported by righthand and lefthand front legs as well as righthand and lefthand rear legs, and a back-rest associated with said rear legs.

Folding chairs are needed particularly at functions and concerts where the number of visitors fluctuates widely. Such fluctuations are accommodated easily by the flexible and rapid setting up of folding chairs.

In general, prior folding chairs fold in one direction only. Thus, when folded, the righthand legs and the lefthand legs are placed against each other by pairs and the seat is turned up or down. Similarly, the front and rear legs may he interconnected by means of rotary joints in cross fashion, said legs to be placed against each other by pairs as the chair is folded.

In both solutions, the problem is that the chairs can be folded in one direction only, which makes space saving stowage more difficult. In addition, the spatial form of the folded chair is hardly compact, which may cause adjacent chairs to get entangled or stuck to each other.

It is the object of the present invention to provide a folding chair which is stable, provides safe seating and folds together in a space saving manner.

This object is achieved by the front legs being movably joined to the rear legs in rotary joints provided at one end thereof and by the front legs being joined to each other for relative movement. In one preferred embodiment, this is accomplished by the front legs being interconnected by intersecting front cross braces and the rear legs being interconnected by intersecting rear cross braces, by said cross braces being relatively movably joined at centrally located rotary joints, and by said cross braces being adapted to be moved relative to the associated front or rear legs in sliding guide means.

By the aforesaid measures, the righthand legs and the lefthand legs are placed against each other as the chair is folded. For folding the chair in an additional direction, the front legs and the rear legs are interconnected by at least one movably arranged brace each. Preferably, the front legs, and the rear legs, are interconnected by two movably disposed intersecting braces. Each brace is secured at one of its ends in a joint and is guided at its other end in sliding guide means. The braces are additionally interconnected by rotary joints disposed at their points of intersection.

Further advantageous measures are described in the dependent claims. The invention is shown in the attached drawing and is described in greater detail hereinbelow.

Figure 1:
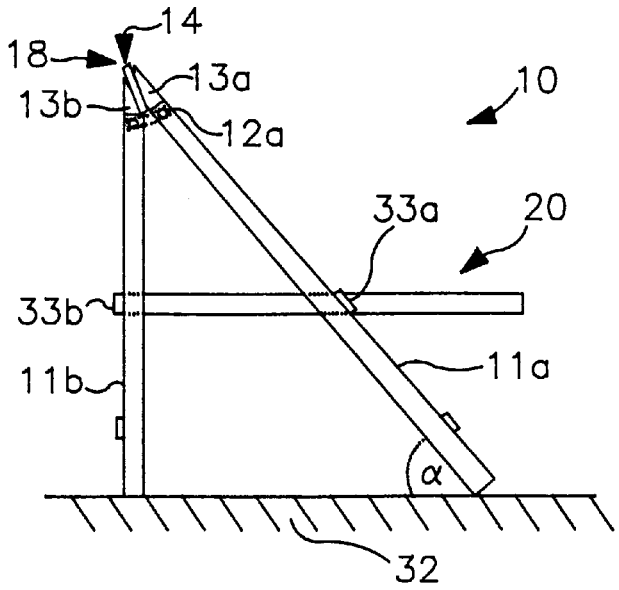
FIG. 1 shows a sideview of an erected chair comprising a seat and legs having tapered portions at their top ends to clampingly hold a back-rest, said legs being interconnected by rotary joints ar their top ends.

Referring to FIG. 1, there is shown a side view of a folding chair 10. Folding chair 10 has two front legs 11*a* and 11*c* and two rear legs 11*b* and 11*d*. Front legs 11*a* and 11*c* are inclined at an angle $\alpha$ relative to rear legs 11*b* and 11*d*, which stand in a substantially vertical position. Lefthand legs 11*a* and 11*b* are connected at their top ends by a rotary joint 12*a*, which allows them to be placed at an angle relative to each other. Righthand legs 11*c* and 11*d* are similarly interconnected by a rotary joint 12*b*. In their mutually inclined position, the pair of lefthand legs 11*a*, 11*b* and the pair of righthand legs 11*c*, 11*d* form a right triangle with floor 32.

Figure 8:
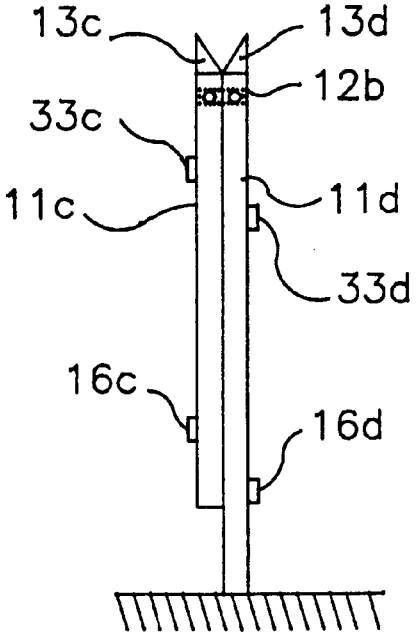
FIG. 8 shows a side view of the chair shown in FIG. 1 in a collapsed condition.

FIG. 8 shows a side view of chair 10 with its righthand legs 11*c* and 11*d* folded to lie against each other, as are lefthand legs 11*a* and 11*b*. Legs 11*a*, 11*b* and 11*c*, 11*d*, respectively, can be placed against each other with their long sides engaging so as to create a compact assembly which lends itself to space saving stowage.

At their top ends, the four legs 11*a*, 11*b*, 11*c* and 11*d* have tapered portions 13*a*, 13*b*, 13*c* and 13*d*, respectively. These tapers are trianglular in shape, with the triangles pointed to the top. The sides adjacent to the tip angle of said triangular tapers 13*a*, 13*b*, 13*c*, 13*d* are linear extensions of the outer edges of legs 11*a*, 11*b*, 11*c*, 11*d*, whereas the hypotenuses of said triangular tapers 13*a*, 13*b*, 13*c*, 13*d* face each other by pairs.

The hypotenuse of taper 13*a* on lefthand rear leg 11*a* is arranged to face the hypotenuse of taper 13*b* on lefthand front leg 11*b*. The hypotenuses of righthand legs 11*c*, 11*d* are similarly oriented. Because of this arrangement, the hypotenuses of tapers 13*a*, 13*b* and of tapers 13*c*, 13*d* engage each other face to face when legs 11*a* to 11*d* are in their mutually angled relative orientation.

As tapers 13*a*, 13*b* and 13*c*, 13*d* engage each other face to face, a back-rest can be clampingly secured between them. Back-rest 14 is released by folding legs 11*a*, 11*b* and 11*c*, 11*d* down against each other.

Figure 2:
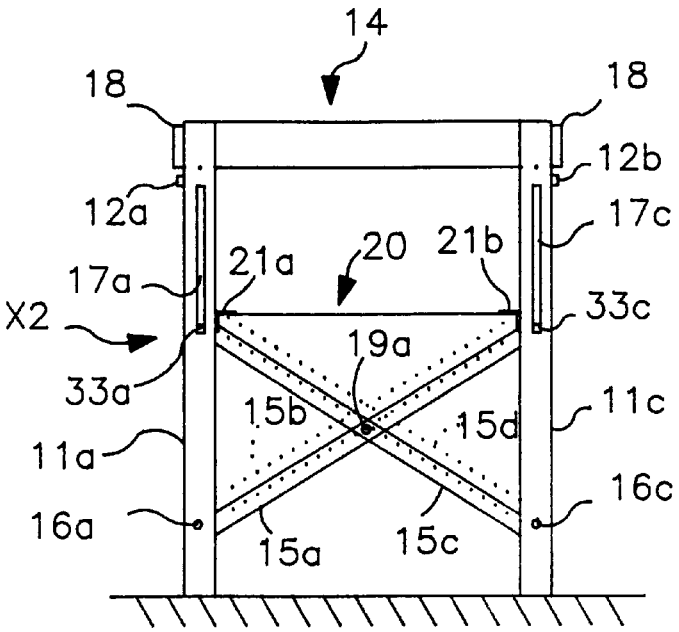
FIG. 2 shows a front view of a chair according to FIG. 1 with intersecting or crossing braces which have their top ends connected to front legs by sliding guide structures and their bottom ends conncted to the front legs by rotary joints.

FIG. 2 shows a front view of folding chair 10. For placing lefthand legs 11*a*, 11*b* against righthand legs 11*c*, 11*d* in a space saving arrangement, front legs 11*a*, 11*c* are interconnected by movable cross braces 15*a*, 15*c*, and rear legs 11*b*, 11*d* are similarly interconnected by cross braces 15*b*, 15*d*.

Front cross brace 15*a* slants upwardly from the bottom end of lefthand front leg 11*a* to righthand front leg 11*c*. Front cross brace 15*c* slants in a mirror-image form so that cross braces 15*c*, 15*a* intersect. Rear cross braces 15*b*, 15*d* extend similarly to interconnect rear legs 11*b*, 11*d*. At the point of intersection cross braces 15*a*, 15*c* are interconnected by a rotary joint l9*a*; at their point of intersection, rear cross braces 15*b*, 15*d* have a rotary joint 19*b*.

The top ends of cross braces 15*a*, 15*b*, 15*c* and 15*d* are slidingly guided in guide structures 17*a*, 17*b*, 17*c* and 17*d*. In accordance with the invention, said guide structures 17*a*, 17*b*, 17*c*, 17*d* comprise recesses or slots extending upwardly in parallel with the long sides of legs 11*a*, 11*b*, 11*c*, 11*d*. Said slots guide pins 33*a*, 33*b*, 33*c* and 33*d* connected with legs 11*a*, 11*b*, 11*c*, 11*d*. At their bottom ends, cross braces 15*a*, 15*b*, 15*c*, 15 are secured to legs 11*a*, 11*b*, 11*c*, 11*d* through pivoting joints 16*a*, 16*b*, 16*c* and 16*d*.

Figure 6:
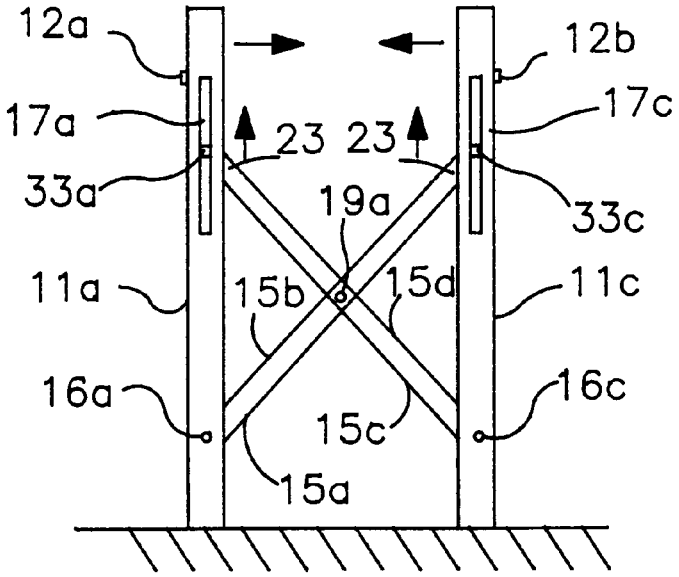
FIG. 6 shows a front view of the chair in FIG. 2 in a partly folded condition, with the back rest and the seat removed.
Figure 7:
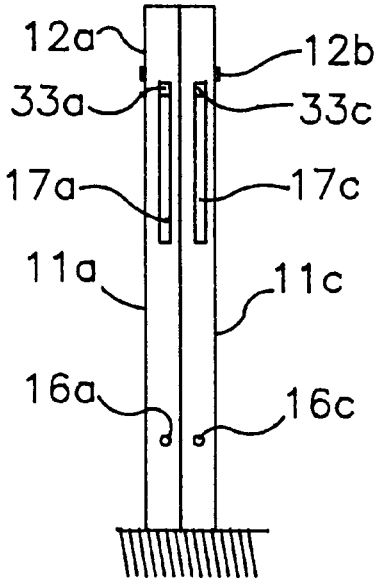
FIG. 7 shows a front view of the chair shown in FIG. 6 in a completely folded condition.

As shown in FIGS. 6 and 7, the top ends of cross brace 15*a*, 15*b*, 15*c*, 15*d* are free to slidingly move upwards as righthand legs 11*c*, 11*d* are placed against lefthand legs 11*a*, 11*b*. When the legs engage each other along their long sides, as shown in FIG. 7, pins 33*a*, 33*b*, 33*c*, 33*d* abut the top ends of guide slots 17*a*, 17*b*, 17*c*, 17*d*.

FIGS. 1 to 5 show the manner of securing seat 20 in place. Seat 20 extends approximately in parallel with floor 32. The rear corners of seat are connected flush with rear legs 11*b*, 11*d*. In the central portions of the side edges, seat 20 is connected wiht front legs 11*a*, 11*c*. Seat 20 is carried by two longitudinally extending seat supporting bars 21*a*, 21*b* that have a web of seat fabric 28 strung between them.

Figure 5:
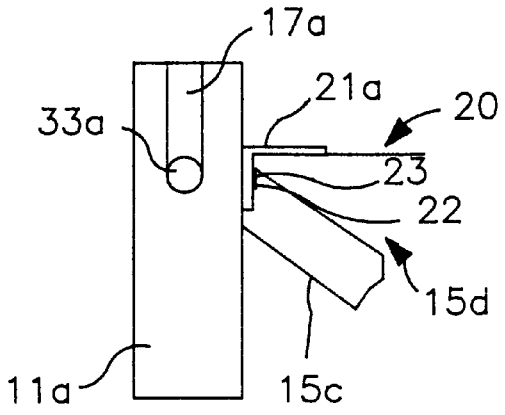
FIG. 5 shows on an enlarged scale a portion X2 of FIG. 2 in which seat brace has a seat brace recess adapted to connect with a brace recess in the braces.

Seat supporting bars 21*a*, 21*b* preferably consist of lengths of L-section bar material. Seat 20 is secured to front legs 11*a*, 11*c* by means of slot-shaped recesses 23 provided at the top ends of the side edges of cross braces 15*a*, 15*c*, as shown in FIGS. 5 and 6.

When spaced to the maximum extent, recesses 23 extend substantially in a parallel offset relationship to front legs 11*a*, 11*c*. In this maximum position, recesses 23 of cross braces 15*a* and 15*c*, respectively, extend downwardly from the top edges thereof. In order to obtain optimum stability, recesses 23 are provided about midway across the width of cross braces 15*a* and 15*c*. The sides facing front legs 11*a* and 11*c*, respectively, of recesses 23 are coextensive with the inner edges thereof.

Figure 11:
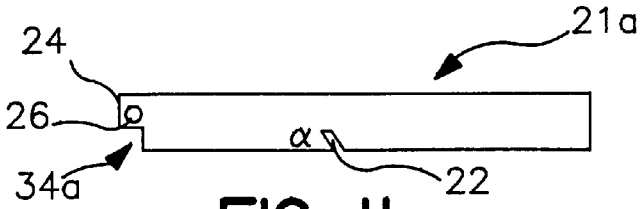
FIG. 11 shows a side view of a seat brace having a seat brace recess and a projection at its left end, said projection carrying a guide pin.

As shown in FIG. 11, seat supporting bars 21*a* and 21*b* each have therein a recess 22 to engage one of the recesses 23 in front cross braces 15*a*, 15*c*. This engagement keeps seat 20 from shifting horizontally. The use of L-section bars for seat supporting bars 21*a*, 21*b* results in the seating load being distributed uniformly among legs 11*a*, 11*c* and cross braces 15*a*, 15*c*.

Figure 3:
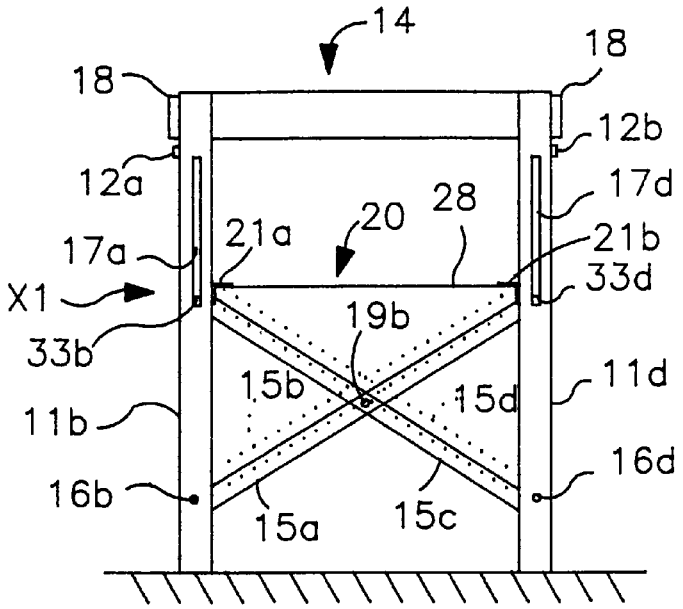
FIG. 3 shows a rear view of a chair according to FIG. 1 with its legs held in a spaced relationship by cross braces, said legs having their top ends guided in sliding guide structures for connection to the rear legs and their bottom ends connected to the rear legs through rotary joints.
Figure 4:
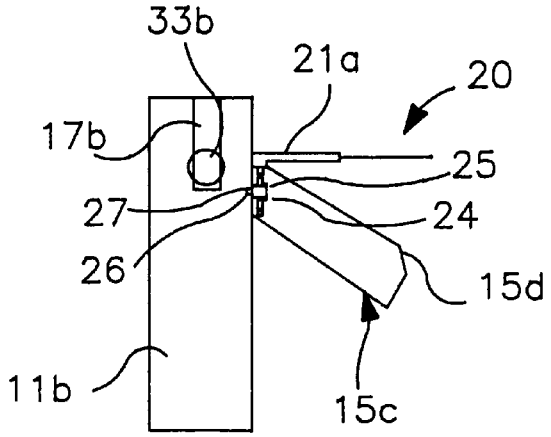
FIG. 4 shows on an enlarged scale a portion X1 of FIG. 3 where a seat brace has a projection at a rear end thereof, said projection being passed through a recess provided at the top end of the rear braces and comprising a guide pin engaging a recess provided on a rear leg.
Figure 12:
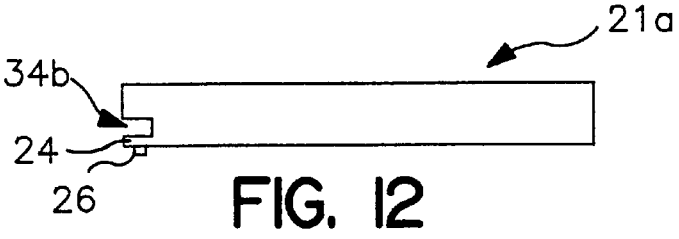
FIG. 12 shows a plan view of the seat brace shown in FIG. 11.

FIG. 4 shows portion X1 of FIG. 3 on an enlarged scale, illustrating how the rear end of seat 20 is connected to rear legs 11*b*, 11*d*. In this respect, and as shown by FIGS. 11 and 12, supporting bars 21*a*, 21*b* have at the rear ends thereof tabs 24 with guide pins 26 projecting outwardly from their outer surface.

Figure 13:
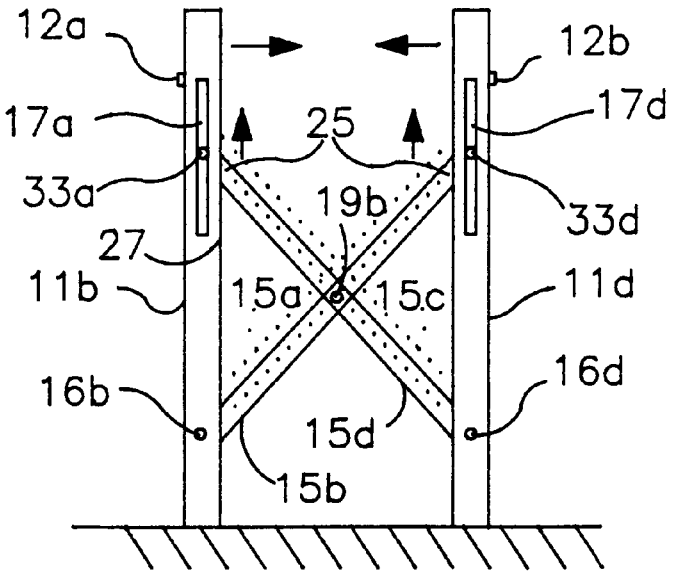
FIG. 13 shows a rear view of the chair illustrated in FIG. 6 with recesses in the braces and in the rear legs for mounting the seat.

Tabs 24 are formed to be integral with seat supporting bars 21*a*, 21*b*. Seat supporting bars 21*a*, 21*b* have recesses 34*a*, 34*b* in the general area of tabs 24. For connecting seat 20 with rear legs 11*b*, 11*d*, cross braces 15*b*, 15*d* have recesses 25 at their top ends. As shown in FIGS. 4 and 13, guide pins 26 engage recesses 25 at tabs 24.

As shown in FIG. 13, the outwardly facing sides of recesses 25 are coextensive with the inner edges of rear leags 11*b*, 11*d*, with the exception of that portion of recess 25 through which guide pins 26 are passed.

As shown in FIG. 4, guide pins 26 include recesses 27 for each one of legs 11*b* and 11*d*. In the maximally spaced position of legs 11*b*, 11*d*, the portion of the recess through which guide pins 26 are passed overlies leg recesses 27. With seat 20 assembled to folding chair 10, guide pins 26 engage leg recesses 27, causing the seating load to be transmitted to rear legs 11*b*, 11*d*.

Figure 9:
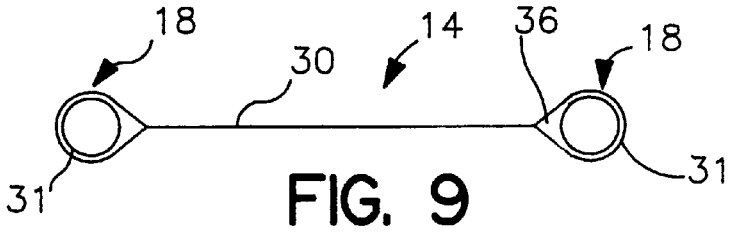
FIG. 9 shows a plan view of the back rest comprising a web of fabric wrapped around two tubular members.

As shown in FIG. 9, back rest 14 has at its opposite ends enlarged portions 18 to prevent it from slipping from the clamping retention arragement. Back rest 14 comprises a back-rest web of fabric 30 having lateral pockets 36 at both ends thereof. Pockets 36 receive tubular sleeves 31 that form said enlarged portions 18.

Figure 10:
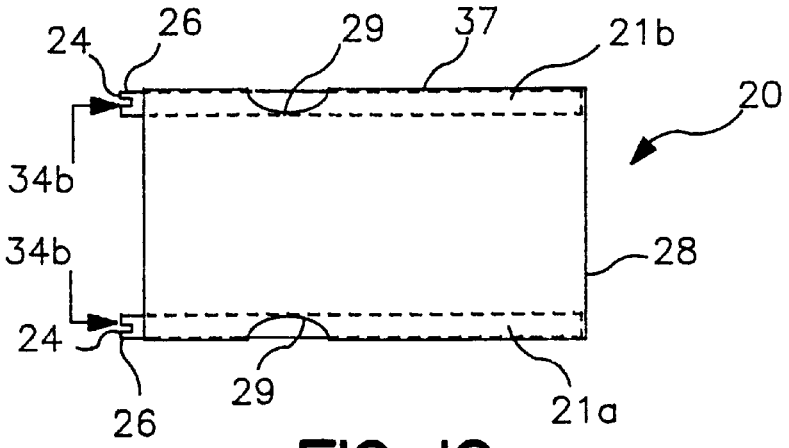
FIG. 10 shows the plan view of a seat having seat supports wrapped by a web of seat fabric, said seat fabric being cut out in the area of the seat brace recesses.

FIG. 10 shows seat 20 to have two seat supporting bars 21*a*, 21*b* extending longitudinally along the sides thereof. Said laterally extending supporting bars 21*a*, 21*b* have a web of fabric 28 associated therewith to serve as a seat.

Seat web 28 has pockets 37 extending along the side edges thereof to removably receive supporting bars 21*a*, 21*b*. Portions 29 are cut from seat web 28 in positions where supporting bars 21*a*, 21*b* are to be connected to front legs 11*a*, 11*c*. Said portions 29 prevent damage to seat web 28 at the highly stressed points of connection. Seat web 28 does not extend to cover the rear portions of seat supporting bars 21*a*, 21*b* so as to reduce the load on rear legs 11*b*, 11*d*.

In an embodiment not shown, seat 20 is connected to legs 11*a*, 11*b*, 11*c*, 11*d* by articulation means. For example, rear ends of seat supporting bars 21*a*, 21*b* may be connected to rear legs 11*b*, 11*d* through rotary or pivoting joints, enabling seat 20 to be turned up or down as the chair is folded.

FIGS. 11 and 12 show the construction of seat supporting bar 21*a*, which is a mirror-image embodiment of seat supporting bar 21*b*. As described above, each seat supporting bar 21*a*, 21*b* has at the rear end thereof a projection or tab 24 holding a guide pin 26. Tabs 24 are integrally joined to seat supporting bars 21*a*, 21*b* and are delimited laterally by recesses 34*a*, 34*b*. Seat supporting bars 21*a*, 21*b* have recesses 22 therein, as shown in FIG. 11. As shown in FIG. 5, recesses 22 are adapted to be made to cooperate effectively with recesses 23 provided in front cross braces 15*a*, 15*b*.

Recesses 23 extend in the form of slots in a rearwardly inclined direction from the bottom lateral edge of seat supporting bars 21*a* or 21*b*. This orientation corresponds to angle $\alpha$ of front legs 11*a*, 11*c*, as shown in FIG. 1, to ensure a horizontal position of seat 20 in the inclined position of legs 11*a*, 11*c*. Supporting bars 21*a*, 21*b* are L-shaped in cross-section. Legs 11*a*, 11*b*, 11*c* and 11*d* consist of L-section bars, as do supporting bars 21*a*, 21*b*.

Figure 14:
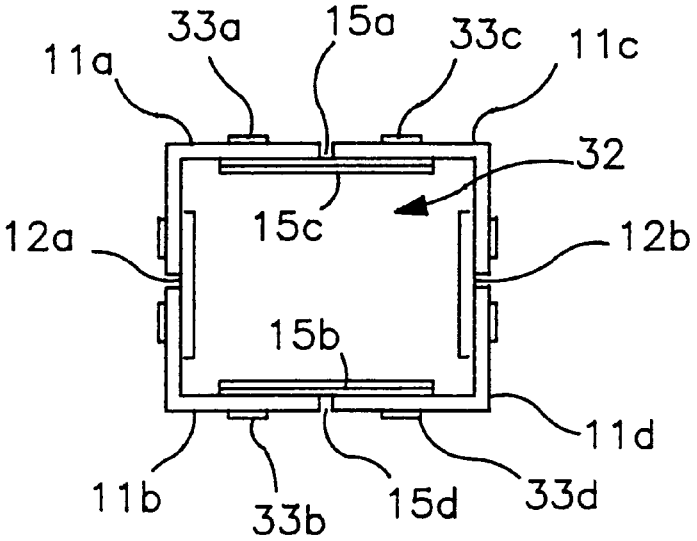
FIG. 14 shows a plan view of the chair collapsed and folded as illustrated in FIGS. 7 and 8, showing said legs to be L-shaped in section and to be interconnected by joints and braces.

In the folded condition, there is formed—see FIG. 14—a square-section hollow tube 35 delimited by the L-section bars of long sides of legs 11*a*, 11*b*, 11*c*, 11*d*. This hollow space 35 will accommodate seat 20 and back-rest 14, which have been removed from th assembly before. This manner of stowing seat 20 and back-rest 14 allows chair 10 to be folded together into a compact and space saving square-section tube which is very easy to store. To provide a free inner space 35 as big as possible, cross braces 15*a*, 15*b*, 15*c*, 15*d* are formed of flat-section bar material.

I claim:

1. A folding chair comprising a seat carried by a righthand front leg, a lefthand front leg, a righthand rear leg and a lefthand rear leg;

a back-rest supportingly engageable with said legs;

each of said front legs being interconnected to a respective rear leg through a rotary joint provided for relative movement therebetween;

a pair of intersecting front cross braces relatively movably interconnecting said front legs, said pair of intersecting front cross braces being connected to one another at a central location for rotation relative to each other, an end of each of said pair of intersecting front cross braces being slidingly movable relative to an associated front leg in a sliding guide;

a pair of intersecting rear cross braces relatively movably interconnecting said rear legs, said pair of intersecting rear cross braces being connected to one another at a central location for rotation relative to each other, an end of each of said pair of intersecting rear cross braces being slidingly movable relative to an associated rear leg in a sliding guide;

wherein said seat comprises a web of seat fabric and a pair of seat supporting bars, said web having seat pockets formed along laterally outward edges thereof, each said seat pocket being slidably receivable of a seat supporting bar, said seat being adapted to be supportingly connected with said front legs and said rear legs by said seat supporting bars received in said seat pockets;

wherein each said seat supporting bar has a recess formed therein, each said recess being cooperatively engageable with one of said pair of intersecting front cross braces.

2. The folding chair as claimed in claim 1, wherein a second end of each of said pair of intersecting front cross braces is rotatably connected to an associated front leg through a rotary joint provided at an end opposite said sliding guide and a second end of each of said pair of intersecting rear cross braces is rotatably connected to an associated rear leg through a rotary joint provided at an end opposite said sliding guide.

3. The folding chair as claimed in claim 1, wherein each of said front legs and each of said rear legs have a top end and each of said front legs and each of said rear legs have at their top end a tapered portion; each said rotary joint, interconnecting a front leg to a respective rear leg, being located adjacent said tapered portions.

4. The folding chair as claimed in claim 3, wherein said back-rest is clampingly held between said front legs and said rear legs at said tapered portions.

5. The folding chair as claimed in claim 4, wherein said back-rest includes laterally outward enlarged portions, said enlarged portions being clampingly removably held between respective front and rear legs at said tapered portions.

6. The folding chair as claimed in claim 5, wherein said back-rest comprises a back-rest web of fabric, and said enlarged portions of said back rest comprise pockets formed at laterally outward ends of said web of fabric.

7. The folding chair as claimed in claim 1, wherein each said seat supporting bar has at one end thereof a projecting tab for cooperatively engaging with one of said pair of intersecting rear cross braces.

8. The folding chair as claimed in claim 7, wherein each said projecting tab further includes a guide pin engageable with a recess on a respective rear leg.

9. The folding chair as claimed in claim 1, wherein each said seat pocket has a cut-out proximate said recess formed in said supporting bar.

10. The folding chair as claimed in claim 1, wherein said seat is removable.

11. The folding chair as claimed in claim 1, wherein said front legs, said rear legs and said seat supporting bars comprise L-section bars; and said pair of intersecting front cross braces and said pair of intersecting rear cross braces comprise flat-section bars.

12. The folding chair as claimed in claim 11, wherein, when in a folded state, said front legs and said rear legs define a hollow space receivable of said back-rest and said seat.

13. A folding chair comprising a seat carried by a righthand front leg, a lefthand front leg, a righthand rear leg and a lefthand rear leg;

a back-rest supportingly engageable with said legs;

each of said front legs being interconnected to a respective rear leg through a rotary joint provided for relative movement therebetween;

each of said front legs and each of said rear legs having a top end;

each of said front legs and each of said rear legs having at their top end a tapered portion;

each said rotary joint, interconnecting a front leg to a respective rear leg, being located adjacent said tapered portions;

said back-rest being clampingly held between said front legs and said rear legs at said tapered portions.

14. The folding chair as claimed in claim 13, further comprising a pair of intersecting front cross braces relatively movably interconnecting said front legs, said pair of intersecting front cross braces being connected to one another at a central location for rotation relative to each other, an end of each of said pair of intersecting front cross braces being slidingly movable relative to an associated front leg in a sliding guide, a pair of intersecting rear cross braces relatively movably interconnecting said rear legs, said pair of intersecting rear cross braces being connected to one another at a central location for rotation relative to each other, an end of each of said pair of intersecting rear cross braces being slidingly movable relative to an associated rear leg in a sliding guide.

15. The folding chair as claimed in claim 14, wherein said seat comprises a web of seat fabric and a pair of seat supporting bars, said web having seat pockets formed along laterally outward edges thereof, each said seat pocket being slidably receivable of a seating supporting bar, said seat being adapted to be supportingly connected with said front legs and said rear legs by said seat supporting bars received in said seat pockets.

16. The folding chair as claimed in claim 15, wherein said front legs, said rear legs and said seat supporting bars comprise L-section bars; and said pair of intersecting front cross braces and said pair of intersecting rear cross braces comprise flat-section bars.

17. The folding chair as claimed in claim 16, wherein, when in a folded state, said front legs and said rear legs define a hollow space receivable of said back-rest and said seat.

18. The folding chair as claimed in claim 14, wherein a second end of each of said pair of intersecting front cross braces is rotatably connected to an associated front leg through a rotary joint provided at an end opposite said sliding guide and a second end of each of said pair of intersecting rear cross braces is rotatably connected to an associated rear leg through a rotary joint provided at an end opposite said sliding guide.

19. The folding chair as claimed in claim 13, wherein said back-rest includes laterally outward enlarged portions, said enlarged portions being clampingly removably held between respective front and rear legs at said tapered portions.

20. The folding chair as claimed in claim 19, wherein said back-rest comprises a back-rest web of fabric, and said enlarged portions of said back rest comprise pockets formed at laterally outward ends of said web of fabric.

21. The folding chair as claimed in claim 15, wherein each said seat supporting bar has a recess formed therein, each said recess being cooperatively engageable with one of said pair of intersecting front cross braces.

22. The folding chair as claimed in claim 21, wherein each said seat supporting bar has at one end thereof a projecting tab for cooperatively engaging with one of said pair of intersecting rear cross braces.

23. The folding chair as claimed in claim 22, wherein each said projecting tab further includes a guide pin engageable with a recess on a respective rear leg.

24. The folding chair as claimed in claim 21, wherein each said seat pocket has a cut-out proximate said recess formed in said supporting bar.

25. The folding chair as claimed in claim 13, wherein said seat is removable.

* * * * *